US011065881B2

(12) United States Patent
Kasamatsu

(10) Patent No.: US 11,065,881 B2
(45) Date of Patent: Jul. 20, 2021

(54) IMAGE FORMING APPARATUS

(71) Applicant: Brother Kogyo Kabushiki Kaisha, Nagoya (JP)

(72) Inventor: Daisuke Kasamatsu, Chita-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/816,420

(22) Filed: Mar. 12, 2020

(65) Prior Publication Data

US 2020/0307237 A1 Oct. 1, 2020

(30) Foreign Application Priority Data

Mar. 28, 2019 (JP) ..... JP2019-063711

(51) Int. Cl.
*B41J 2/175* (2006.01)

(52) U.S. Cl.
CPC ..... *B41J 2/17566* (2013.01); *B41J 2/1752* (2013.01); *B41J 2/17506* (2013.01); *B41J 2/17546* (2013.01); *B41J 2002/17569* (2013.01); *B41J 2002/17589* (2013.01)

(58) Field of Classification Search
CPC ..... B41J 2/175; B41J 2/17506; B41J 2/1752; B41J 2/17546; B41J 2/17566; B41J 2002/17569; B41J 2002/17589
See application file for complete search history.

(56) References Cited

U.S. PATENT DOCUMENTS

2005/0195446 A1* 9/2005 Kasatani ..... H04N 1/00222 358/402
2007/0257954 A1* 11/2007 Nishizaka ..... B41J 13/103 347/14
2014/0083779 A1* 3/2014 Sharma ..... G01G 19/44 177/1

FOREIGN PATENT DOCUMENTS

JP 2008-076550 A 4/2008

* cited by examiner

*Primary Examiner* — Anh T Vo
(74) *Attorney, Agent, or Firm* — Burr & Brown, PLLC

(57) ABSTRACT

In an image forming apparatus, a controller is configured to: obtain conformance information, for each of at least one color, representing each container conforming to the image forming apparatus; obtain usage information related to a relationship between the total number of recording media on which images are formed within a past particular period and a total amount of a colorant used within the past particular period; based on the obtained usage information, calculate a first initial formable number for each of the at least one color which represents the total number of recording media on which images are respectively formable using the colorant with a particular initial containing amount; and display a detailed-information screen containing conformance detailed information for each of the at least one color. The obtained conformance information and the first initial formable number are associated with each other in the conformance detailed information.

9 Claims, 9 Drawing Sheets

IMAGE FORMING APPARATUS

CROSS REFERENCE TO RELATED APPLICATION

The present application claims priority from Japanese Patent Application No. 2019-063711, which was filed on Mar. 28, 2019, the disclosure of which is herein incorporated by reference in its entirety.

BACKGROUND

The following disclosure relates to a technique of providing information relating to a container containing a colorant to be used by an image forming apparatus.

There is known an image forming apparatus configured to detect a remaining amount of toner, calculate the number of recording sheets printable using the detected remaining amount of the toner, and display the calculated printable number on a display device.

SUMMARY

Users of image forming apparatuses configured to perform printing using a colorant, e.g., toner, such as the above-described image forming apparatus generally consider newly purchasing a container (e.g., a cartridge) containing the colorant, to enable the image forming apparatus to perform printing even after the container becomes empty of the colorant used at present.

To allow the user to easily recognize the container to be purchased, it is considered to display the model number of a usable container on a display device of the image forming apparatus, for example. However, the number of the kinds of the usable containers is not limited to one, and the user can in some case use the container by selecting one of the containers of a plurality of kinds even in the same color. Specifically, it is assumed that a plurality of kinds of containers different in amount of the colorant contained are on sale, and the user needs to select and purchase one of the containers, for example. In this case, only providing the user with the model numbers is not sufficient, making it difficult for the user to determine which model number is to be chosen to purchase the container.

Also in the case where the number of the kinds of the usable containers is only one, only providing the user with the model number may be insufficient for some user to appropriately determine the timing for purchasing the container corresponding to the model number.

Accordingly, an aspect of the disclosure relates to an image forming apparatus capable of appropriately providing the user with useful information for purchasing a container containing a colorant.

In one aspect of the disclosure, an image forming apparatus includes: an image forming device configured to form an image on a recording medium by applying a colorant onto the recording medium from at least one container corresponding respectively to at least one color; a display device; and a controller configured to: obtain conformance information, for each of the at least one color, representing each of the at least one container conforming to the image forming apparatus; obtain usage information related to a relationship between (i) the total number of recording media on which images are respectively formed by the image forming device within a past particular period and (ii) a total amount of the colorant of the at least one color which is used by the image forming device within the past particular period; calculate a first initial formable number for each of the at least one color based on the obtained usage information, the first initial formable number representing the total number of recording media on which images are respectively formable using the colorant with a particular initial containing amount which is stored in each of the at least one container; and control the display device to display a detailed-information screen containing conformance detailed information for each of the at least one color, the conformance detailed information being information in which the obtained conformance information and the first initial formable number are associated with each other.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

EMBODIMENT

Hereinafter, there will be described one embodiment by reference to the drawings.

1. Configuration of Image Processing System

Figure 1:
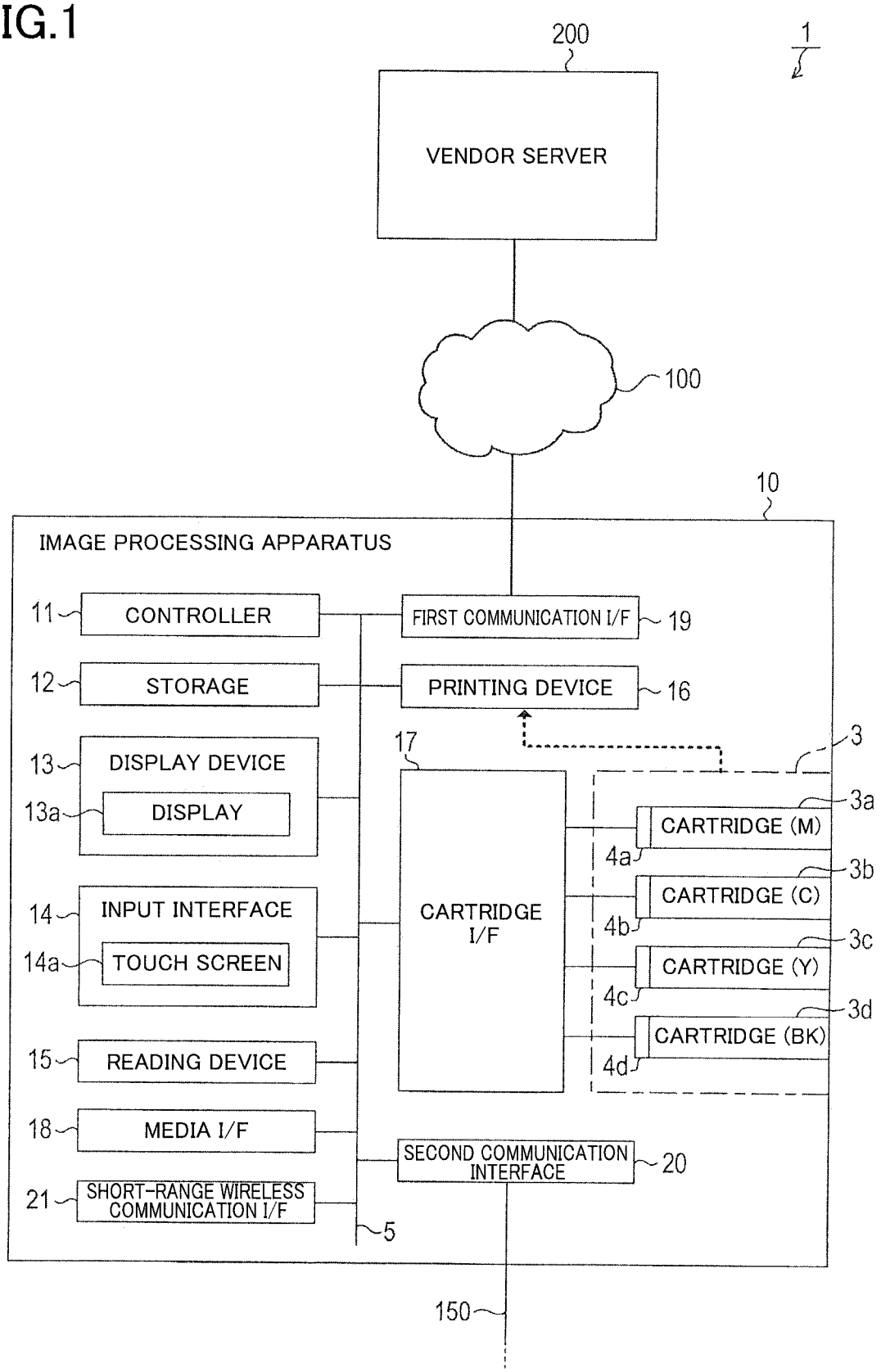
FIG. 1 is a view for explaining a configuration of an image processing system in an embodiment.

As illustrated in FIG. 1, an information processing system 1 includes an image processing apparatus 10 according to the present embodiment and a vendor server 200. The image processing apparatus 10 and the vendor server 200 are capable of performing data communication with each other over a network 100. The network 100 may be any network. The network 100 may be any of a wired network and a wireless network, for example. Each of the wired network and the wireless network may employ any communication standard.

2. Configuration of Image Processing Apparatus 10

The image processing apparatus 10 according to the present embodiment in FIG. 1 has a plurality of functions including a scanning function, a printing function, a copying function, and a facsimile function, for example. The scanning function is a function for reading an image formed on a document to create image data based on the read image. The printing function is a function for printing an image on a recording sheet. The copying function is a function using the printing function to print an image read in the scanning function. The facsimile function is a function for transmitting and receiving facsimile data.

As illustrated in FIG. 1, the image processing apparatus 10 includes a controller 11, a storage 12, a display device 13, an input interface 14, a reading device 15, a printing device 16, a cartridge interface 17, a media interface 18, a first communication interface 19, a second communication interface 20, and a short-range wireless communication interface 21, which are connected to each other via a bus 5.

The image processing apparatus 10 includes a mount portion 3. A plurality of cartridges are removably mountable on the mount portion 3. In the present embodiment, four cartridges 3*a*, 3*b*, 3*c*, 3*d* corresponding respectively to four colors, namely, magenta, cyan, yellow, and black are removably mountable on the mount portion 3. The cartridge 3*a* stores magenta ink. The cartridge 3*b* stores cyan ink. The cartridge 3*c* stores yellow ink. The cartridge 3*d* stores black ink.

Each of the cartridges 3*a*, 3*b*, 3*c*, 3*d* in a new condition stores the ink of an initial containing amount. The new condition is a state in which the cartridge is manufactured by a manufacturer and available to consumers but has not been handed over or delivered to a specific user.

In the present embodiment, each of the cartridges 3*a*, 3*b*, 3*c*, 3*d* is sealed in a corresponding one of packing package under vacuum and shipped. Thus, the new condition in the present embodiment specifically means a state in which each of the cartridges 3*a*, 3*b*, 3*c*, 3*d* is shipped, that is, each of the cartridges 3*a*, 3*b*, 3*c*, 3*d* is sealed in the packing package and unopened. It should be understood that this definition of the new condition is one example, and the new condition may be a state different from the above-described state. For example, the new condition may be a state in which the packing package has been opened, but the cartridge has not been used and stores the initial containing amount of the ink.

The magenta-ink cartridge 3*a* is provided with a cartridge circuit 4*a*. The cartridge circuit 4*a* includes an information memory. The information memory stores internal cartridge information. The internal cartridge information includes conformance information, an ISO-based printable number, and a validity period. The cartridge circuit 4*a* may be provided in any manner. For example, the cartridge circuit 4*a* may be provided in an IC chip.

The conformance information stored in the information memory of the cartridge circuit 4*a* indicates the model numbers of respective magenta-ink cartridges conforming to the image processing apparatus 10, and the model numbers include the model number of the cartridge 3*a* provided with the cartridge circuit 4*a*.

Conforming to the image processing apparatus 10 means that the cartridge is mountable on the mount portion 3. The word "mountable" means not only that the cartridge is physically mountable but also that the cartridge is physically mountable and allows the printing device 16 to perform appropriate printing with the ink stored in the cartridge. In the following description, a conforming cartridge means a cartridge conforming to the image processing apparatus 10, and a conforming model number means the model number of the conforming cartridge.

A plurality of the conforming cartridges may exist for the same color. That is, there may be a plurality of the conforming cartridges different from each other in the initial containing amount of the ink even for the same color, for example. The ISO-based printable number and the validity period in the internal cartridge information correspond to each model number indicated by the conformance information.

The ISO-based printable number represents the number of the recording sheets printable in the case where printing is performed in the testing method defined by ISO. The testing method defined by ISO is a method of printing the predetermined pattern image on the predetermined recording sheet under the predetermined environment (at the predetermined temperature, for example). The ISO-based printable number in the internal cartridge information represents the number of the recording sheets printable using the initial containing amount of the ink.

It is noted that the internal cartridge information may contain the initial containing amount of the ink instead of or in addition to the printable number. The validity period represents a period in which, after the cartridge being in the new condition is changed to a particular usable state, the ink in the cartridge can be kept in its appropriate state (in other words, a printing result with an appropriate quality can be obtained using the ink in the cartridge). In the present embodiment, the particular usable state is a state in which the packing package is opened, for example. That is, the validity period in the present embodiment is a period starting from the time of opening of the packing package. The manufacturer of the cartridge recommends the user to use all the ink in the cartridge within the validity period. The validity period is determined by the manufacturer of the cartridge, and examples of the validity period include six months, one year, and two years. The validity period is, for example, printed on a surface of an individual packaging box for the cartridge to allow the user to visually recognize the validity period before purchase.

The cyan-ink cartridge 3*b*, the yellow-ink cartridge 3*c*, and the black-ink cartridge 3*d* are similar in construction to the magenta-ink cartridge 3*a*. That is, the cyan-ink cartridge 3*b* is provided with a cartridge circuit 4*b*. This cartridge circuit 4*b* is similar in construction to the magenta-ink cartridge circuit 4*a*. That is, the cartridge circuit 4*b* includes the information memory that stores the internal cartridge information including: the conformance information representing the model number of the cyan-ink conforming cartridge; and the ISO-based printable number and the validity period for the conforming cartridge.

The yellow-ink cartridge 3*c* is provided with a cartridge circuit 4*c*. This cartridge circuit 4*c* is also similar in construction to the magenta-ink cartridge circuit 4*a*. That is, the cartridge circuit 4*c* includes the information memory that stores the internal cartridge information including: the conformance information representing the model number of the yellow-ink conforming cartridge; and the ISO-based printable number and the validity period for the conforming cartridge.

The black-ink cartridge 3*d* is provided with a cartridge circuit 4*d*. This cartridge circuit 4*d* is also similar in construction to the magenta-ink cartridge circuit 4*a*. That is, the cartridge circuit 4*d* includes the information memory that stores the internal cartridge information including: the conformance information representing the model number of the black-ink conforming cartridge; and the ISO-based printable number and the validity period for the conforming cartridge.

The controller 11 includes a central processing unit (CPU), for example. The storage 12 includes semiconductor memories including a read-only memory (ROM), a random-access memory (RAM), a nonvolatile random access memory (NVRAM), and a flash memory, for example. That is, the image processing apparatus 10 according to the present embodiment includes a microcomputer including the CPU and the semiconductor memories.

The controller 11 performs various functions by executing programs stored in a non-transitory storage medium. In the present embodiment, the storage 12 is one example of the non-transitory storage medium storing the programs. It is noted that the various functions to be performed by the controller 11 are not limited to those performed by execution of the programs (i.e., a software processing), and some or all of the functions may be performed using one or more hardware devices.

Figure 2:
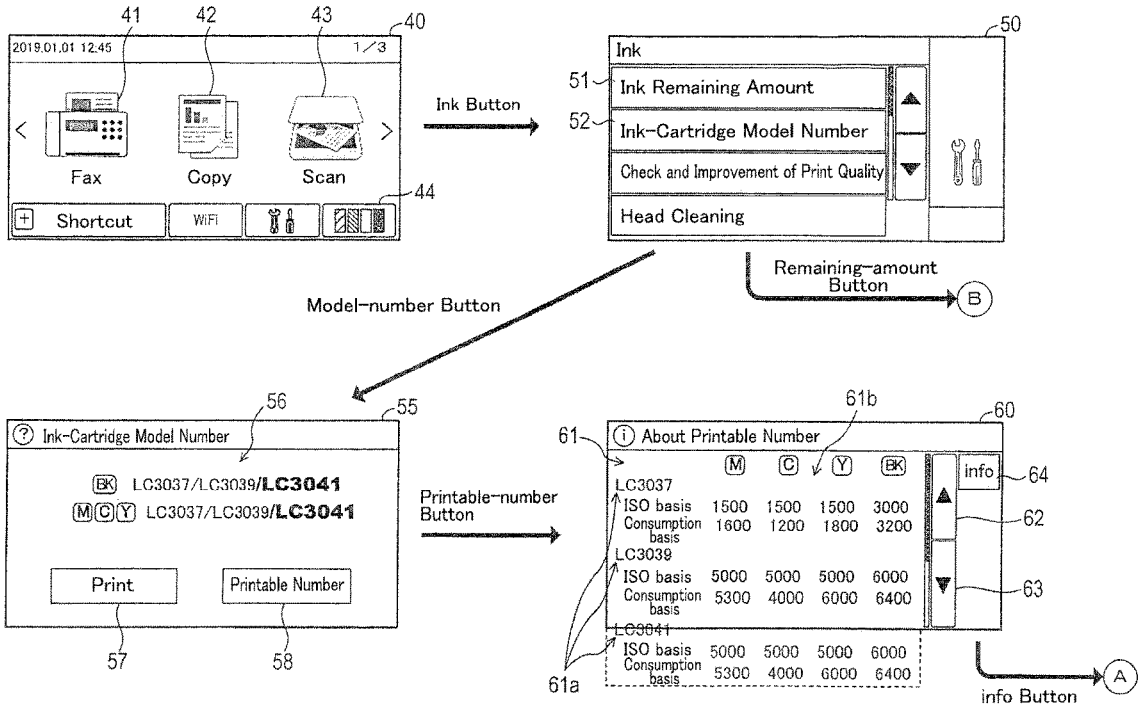
FIG. 2 is a view for explaining a portion of an example of screen transition when displaying various kinds of information relating to a conforming cartridge.
Figure 3:
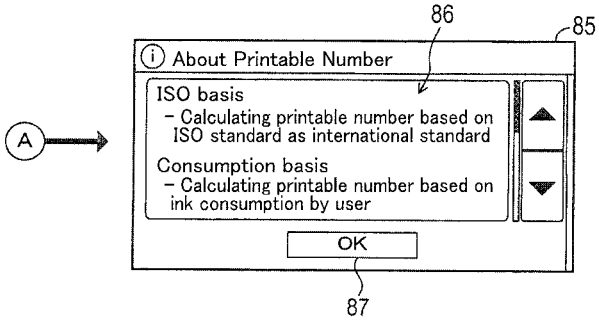
FIG. 3 is a view for explaining another portion of the example of the screen transition (continued from FIG. 2) when displaying various kinds of information relating to the conforming cartridge.
Figure 4:
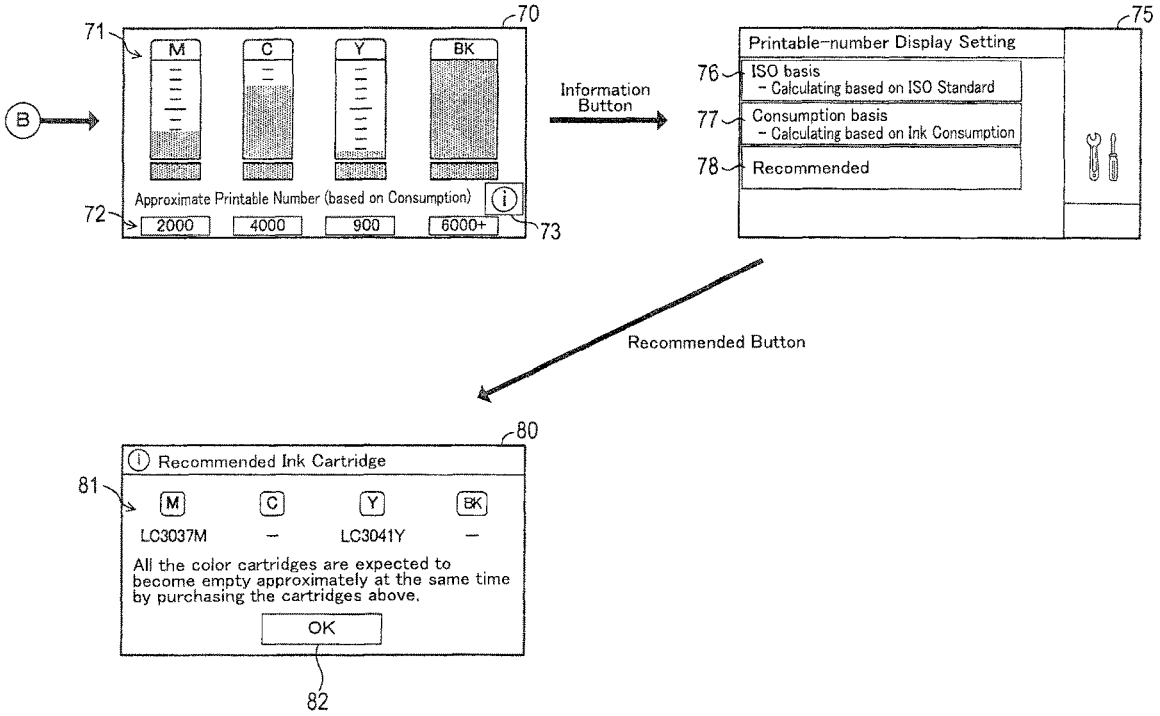
FIG. 4 is a view for explaining yet another portion of the example of the screen transition (continued from FIG. 2) when displaying various kinds of information relating to the conforming cartridge.

The storage 12 stores data relating to various screens including screens illustrated in FIGS. 2-4. The storage 12 further stores programs for an ink menu process illustrated in FIGS. 5-8.

The display device 13 in the present embodiment includes a display 13*a* for displaying various kinds of information. The input interface 14 includes an input device for accepting various input operations. In the present embodiment, the input interface 14 includes a touch screen 14*a* as the input device. The touch screen 14*a* is superposed on an image display region of the display device 13. The image display region is a region on which an image is to be displayed.

The touch screen 14*a* superposed on the image display region of the display device 13 is configured to detect an instructing operation that is a touch or an approach of an input object on or to the image display region. That is, in the case where a user is performing the instructing operation with the input object relative to the image display region, the touch screen 14*a* can output positional information representing an instructed position at which the user is performing the instructing operation. In the present embodiment, the touch screen 14*a* is configured to continuously or periodically output the positional information while the instructing operation is being performed with the input object.

It is noted that the touch screen 14*a* may be configured to detect any of only a touch of the input object, only an approach of the input object, and both of a touch and an approach of the input object as the instructing operation.

The controller 11 is configured to obtain the positional information output from the touch screen 14*a* and based on the obtained positional information detect (i) the presence or absence of the instructing operation with the input object, (ii) the instructed position in the case where the user is performing the instructing operation, and (iii) at least one type of a specific operation with the input object in the case where the user is performing the instructing operation.

Examples of the specific operation detectable by the controller 11 include a tap, a flick, and a drag. The tap is an operation in which, after the instructing operation is performed with the input object, the input object moves off or away from the touch screen 14*a* at the same position. Examples of the input object to be used for the instructing operation include a fingertip and a particular instructing device such as a stylus.

The reading device 15 includes an image sensor and is configured to read an image formed on a document to create image data based on the read image. The image sensor may be any of a charge-coupled-device (CCD) image sensor and a complementary-metal-oxide-semiconductor (CMOS) image sensor, for example. The document may be any of at least one of a paper sheet, a cloth, and a label, for example.

The printing device 16 in the present embodiment includes an ink-jet printing mechanism and is capable of printing an image on the recording sheet. The printing device 16 ejects the ink of each of the four colors which is stored in a corresponding one of the cartridges 3*a*, 3*b*, 3*c*, 3*d* mounted on the mount portion 3, onto the recording sheet based on print data to form an image represented by the print data, on the recording sheet.

When each of the cartridges 3*a*, 3*b*, 3*c*, 3*d* is mounted on the mount portion 3, the cartridge interface 17 is electrically connected to a corresponding one of the cartridge circuits 4*a*, 4*b*, 4*c*, 4*d*. The controller 11 is capable of obtaining, via the cartridge interface 17, the internal cartridge information from the information memory of each of the cartridge circuits 4*a*, 4*b*, 4*c*, 4*d*.

The media interface 18, for example, is an interface on which at least one of various storage media such as a USB flash memory is to be mounted. The media interface 18 controls writing and reading of data into or from the mounted storage medium.

The first communication interface 19 is a communication interface capable of connecting the image processing apparatus 10 to the network 100. The image processing apparatus 10 is capable of performing data communication via the first communication interface 19 with various information processing devices including the vendor server 200. The image processing apparatus 10 is connectable to the Internet via the first communication interface 19 to perform data communication over the Internet with other various servers and/or various information processing devices, for example.

The second communication interface 20 is an interface for communicating with an external device over a communication network 150. The communication network 150 connected to the second communication interface 20 is a public telephone network in the present embodiment, for example. Transmission and reception of facsimile data in the facsimile function are principally performed via the second communication interface 20.

The short-range wireless communication interface 21 uses a particular short-range wireless communication method to perform wireless communication with another or other wireless communication devices located near the image processing apparatus 10. The short-range wireless communication method may be any method. In the present embodiment, the short-range wireless communication method is a wireless communication method according to the communication standard for near-field communication (NFC), for example.

The short-range wireless communication interface 21 is capable of performing wireless communication with another or other wireless communication devices located in a communicable area of the short-range wireless communication interface 21. One example of the communicable area is an area within a particular distance (e.g., ten-odd centimeters) from a portion of a surface of a housing of the image processing apparatus 10 which is located near (within a specific distance from) a position at which the short-range wireless communication interface 21 is mounted.

3. Vendor Server 200

The vendor server 200 is an information processing device capable of providing various kinds of information. The vendor server 200 stores a plurality of pieces of server cartridge information respectively for various kinds of image forming apparatuses including the image processing apparatus 10 according to the present embodiment and provided by a vendor of the image processing apparatus 10. The image processing apparatus 10 is capable of obtaining, from the vendor server 200, the server cartridge information corresponding to the image processing apparatus 10.

The server cartridge information, for example, includes the conformance information representing the model number of each conforming cartridge and the ISO-based printable number and the validity period for each conforming cartridge, for each color to be used in the corresponding image forming apparatus. It is noted that the server cartridge information may contain the initial containing amount of the ink instead of or in addition to the printable number.

The server cartridge information stored in the vendor server 200 managed and updated as needed by the vendor, for example. Thus, in the case where the number of the types of the conforming cartridge has newly increased after the conforming cartridge for the image processing apparatus 10 is shipped, for example, the conformance information stored in the shipped conforming cartridge does not contain the model number of the new conforming cartridge, but the model number of the new conforming cartridge is added to the conformance information in the server cartridge information.

4. Ink Menu Screen and Example of Screen Transition Starting from Ink Menu Screen When the image processing apparatus 10 is turned on, and the controller 11 is activated, the controller 11 controls the display device 13 to display a standby screen 40 illustrated in FIG. 2. The standby screen 40 functions as an initial screen when the user uses the image processing apparatus 10 to perform various functions.

The standby screen 40 contains a plurality of function buttons each for performing a corresponding one of the functions. The standby screen 40 illustrated in FIG. 2 contains a Fax button 41, a Copy button 42, and a Scan button 43 as the plurality of function buttons by way of example. When the Fax button 41 is selected, the controller 11 performs the facsimile function. When the Copy button 42 is selected, the controller 11 performs the copying function. When the Scan button 43 is selected, the controller 11 performs the scanning function. The selecting operation may be any operation and is a tap in the present embodiment, for example.

The standby screen 40 contains an ink button 44. When the ink button 44 is selected, the display device 13 displays an ink menu screen 50 illustrated in FIG. 2. The ink menu screen 50 contains a plurality of buttons including a remaining-amount button 51 and a model-number button 52. When any one of the buttons is selected, the controller 11 executes a processing corresponding to the selected button.

When the model-number button 52 is selected, the display device 13 displays a conformance-information screen 55 illustrated in FIG. 2. The conformance-information screen 55 contains conforming-model-number information 56, a print button 57, and a printable-number button 58.

The conforming-model-number information 56 represents the conforming model number of at least one conforming cartridge for each of the four colors. In the example in FIG. 2, three conforming model numbers "LC3037", "LC3039", and "LC3041" as the conforming model numbers are displayed for each of the four colors.

The conforming-model-number information 56 principally includes the conforming model numbers represented by the conformance information obtained from each of the cartridge circuits 4*a*, 4*b*, 4*c*, 4*d* provided in the respective cartridges 3*a*, 3*b*, 3*c*, 3*d* being mounted.

It should be noted that the server cartridge information is obtained from the vendor server 200 as described above. In the case where the conforming model numbers contained in the server cartridge information include a model number (or numbers) not contained in the internal cartridge information (hereinafter may be referred to as "non-internal conforming model number"), the conforming-model-number information 56 also includes the non-internal conforming model number.

In the conforming-model-number information 56 displayed on the conformance-information screen 55 illustrated in FIG. 2, the conforming model number "LC3041" of the three model numbers corresponds to the non-internal conforming model number. The non-internal conforming model number is displayed in a display manner different from that for the other conforming model numbers. In the present embodiment, as illustrated in FIG. 2, the non-internal conforming model number is displayed in a font different from that of the other conforming model numbers and in a size greater than that of the other conforming model numbers, for example. It is noted that the non-internal conforming model number may be displayed in any display manner that allows the user to visually distinguish the non-internal conforming model number from the other conforming model numbers.

When the print button 57 is selected on the conformance-information screen 55, the printing device 16 prints the conforming-model-number information 56. When the printable-number button 58 is selected on the conformance-information screen 55, the display device 13 displays a detailed-information screen 60. The detailed-information screen 60 contains a conformance detailed information 61, an up-scroll button 62, a down-scroll button 63, and an information button 64.

The conformance detailed information 61 stores a relationship between each of conforming model numbers 61*a* and printable numbers 61*b* for a corresponding one of the four colors. Each of the printable numbers 61*b* represents the number of the recording sheets printable using the initial containing amount of the ink. Specifically, the ISO-based printable number and a consumption-amount-based printable number are displayed.

The ISO-based printable number represents a value obtained from the internal cartridge information or the server cartridge information, for example. The consumption-amount-based printable number represents the printable number of the recording sheets which is expected in the case where it is assumed that the image processing apparatus 10 is to be used in a tendency similar to the past tendency, based on the past use of the image processing apparatus 10 by the user.

The consumption-amount-based printable number is calculated in a method described below, for example. That is, each time when printing is performed by the printing device 16, the controller 11 stores a printing date, the number of printed sheets which is the number of the recording sheets for which printing has been performed, and a remaining amount of the ink or an amount of the ink used. The controller 11 may cumulatively add the number of printed sheets each time when printing is performed. The controller 11 may obtain the printing date in any method. For example, the controller 11 may include a real-time clock and obtain and store information on the date and time created by the real-time clock each time when printing is performed.

The controller 11 obtains (i) the number of sheets printed within the past particular period and (ii) a total amount of the ink used for each of the four colors within the particular period, at a particular timing when or before displaying the detailed-information screen 60. The start and the end of the particular period may be determined in any manner. For example, the start of the particular period may be a date when a power source of the image processing apparatus 10 is turned on by the user for the first time after the image processing apparatus 10 is shipped. The end of the particular period may be a date when the detailed-information screen 60 is displayed.

The controller 11 calculates a unit amount of ink usage based on the number of printed sheets and the amount of ink usage for each of the four colors within the particular period. The unit amount of ink usage is an average value of an amount of ink used for printing on a single recording sheet for each of the four colors. The controller 11 further calculates, as the consumption-amount-based printable number, the number of the recording sheets printable using the cartridge being in the new condition in the case where it is assumed that the ink of the unit amount of ink usage is to be used for printing to be performed for a single recording sheet. Specifically, the controller 11 calculates the consumption-amount-based printable number by dividing the initial containing amount in the new condition by the unit amount of ink usage for each of the four colors, for example.

The conformance detailed information 61 displayed on the detailed-information screen 60 illustrated in FIG. 2 includes the printable numbers 61*b* for the four colors for the three conforming model numbers "LC3037", "LC3039", and "LC3041". In FIG. 2, for example, the ISO-based printable numbers for the conforming model number "LC3037" are 1500, 1500, 1500, and 3000 respectively for magenta, cyan, yellow, and black, and the consumption-amount-based printable numbers for the conforming model number "LC3037" are 1600, 1200, 1800, and 3200 respectively for magenta, cyan, yellow, and black. Thus, the consumption-amount-based printable number is different from the ISO-based printable number in some cases, depending upon the actual use of the image processing apparatus 10 by the user.

When the information button 64 is selected on the detailed-information screen 60, the display device 13 displays a displayed-number explaining screen 85 illustrated in FIG. 3. The displayed-number explaining screen 85 contains displayed-number information 86 and an OK button 87. The displayed-number information 86 contains supplemental information for the user about meanings of the ISO-based printable number and the consumption-amount-based printable number displayed on the detailed-information screen 60.

When the remaining-amount button 51 is selected on the ink menu screen 50, the display device 13 displays an ink-remaining-amount screen 70 illustrated in FIG. 4. The ink-remaining-amount screen 70 contains an ink-remaining-amount object 71, a printable-number object 72, and an information button 73.

The ink-remaining-amount object 71 is an image which allows the user to visually recognize a remaining amount of the ink in each of the cartridges 3*a*, 3*b*, 3*c*, 3*d*. In the example in FIG. 4, the ink-remaining-amount screen 70 indicates that a remaining amount of the ink in the magenta-ink cartridge 3*a* is about 30% of the initial containing amount, a remaining amount of the ink in the cyan-ink cartridge 3*b* is about 70% of the initial containing amount, a remaining amount of the ink in the yellow-ink cartridge 3*c* is about 10% of the initial containing amount, and a remaining amount of the ink in the black-ink cartridge 3*d* is about 100% of the initial containing amount.

The printable-number object 72 represents remaining printable numbers, each of which is the number of the recording sheets printable using the ink remaining at present for a corresponding one of the four colors. An ISO-based value and a consumption-amount-based value are calculated for each of the remaining printable numbers, and one of the ISO-based value and the consumption-amount-based value which is set for display is displayed. In FIG. 4, the consumption-amount-based remaining printable numbers is set to be displayed.

Each of the ISO-based remaining printable numbers is calculated, based on the amount of the ink remaining at present, in a specific calculating method for calculating the printable number that is assumed to be achieved in the case where printing is performed in the testing method defined by ISO. Each of the consumption-amount-based remaining printable numbers is calculated, based on the amount of the ink remaining at present, in a method similar to the calculating method for the consumption-amount-based printable number.

When the information button 73 is selected on the ink-remaining-amount screen 70, the display device 13 displays a display-setting screen 75 illustrated in FIG. 4. The display-setting screen 75 contains an ISO-basis button 76, a consumption-amount-basis button 77, and a Recommended button 78.

When the ISO-basis button 76 is selected, the ISO-based remaining printable numbers are set to be displayed, and the ink-remaining-amount screen 70 is displayed. In this case, the displayed ink-remaining-amount screen 70 contains the printable-number object 72 representing the ISO-based remaining printable numbers. When the consumption-amount-basis button 77 is selected, the consumption-amount-based remaining printable numbers are set to be displayed, and the ink-remaining-amount screen 70 is displayed. In this case, the ink-remaining-amount screen 70 displayed contains the printable-number object 72 representing the consumption-amount-based remaining printable numbers. It is noted that the printable-number object 72 may represent both the ISO-based remaining printable numbers and the consumption-amount-based remaining printable numbers.

When the Recommended button 78 is selected on the display-setting screen 75, the display device 13 displays a recommended cartridge screen 80 illustrated in FIG. 4. The recommended cartridge screen 80 contains a recommended information 81 and an OK button 82. When the OK button 82 is selected, the display device 13 displays the display-setting screen 75.

The recommended information 81 represents a recommended cartridge for at least one recommended color of the four colors. The recommended cartridge is an optimum conforming cartridge the user is to be recommended to purchase. The conforming cartridge satisfying a first recommended condition is determined as the recommended cartridge for each recommended color.

The first recommended condition is generally a condition in which, after the cartridge for a recommended color is replaced with the recommended cartridge, the recommended cartridge has such an initial containing amount that all the cartridges for three colors different from black or all the cartridges for the four colors including black become empty of the ink substantially at the same time.

Magenta and yellow are the recommended colors on the recommended cartridge screen 80 in FIG. 4. Thus, the model number "LC3037M" is displayed as a recommended magenta-ink cartridge, and the model number "LC3041Y" is displayed as a recommended yellow-ink cartridge. It is noted that the consumption-amount-based printable number for the magenta-ink cartridge corresponding to the model number "LC3037M" is 1600, and the consumption-amount-based printable number for the yellow-ink cartridge corresponding to the model number "LC3041Y" is 6000. This example indicates that in the case where the remaining amount of the ink in each of the magenta-ink cartridge and the yellow-ink cartridge mounted at present becomes zero and thereafter the magenta-ink cartridge and the yellow-ink cartridge are replaced with the respective recommended cartridges, the cartridges for the magenta, cyan, and yellow ink are expected to become empty substantially at the same time.

No consideration is given to the black ink in the example in FIG. 4 because the remaining amount of the black ink is the largest. In the case where there is a cartridge greater than the black-ink cartridge in remaining amount of the ink, however, the recommended colors and the recommended cartridges are determined such that the cartridges for the four colors including black become empty of the ink substantially at the same time.

The determination of the recommended colors and the determination of the recommended cartridges for the recommended colors are performed in a recommended-model-number determining process in FIG. 8 which will be described below.

5. Ink Menu Process

There will be next described the ink menu process to be executed by the controller 11 with reference to FIGS. 5-8. The controller 11 starts the ink menu process when the ink button 44 is selected on the standby screen 40. Screen transition after selection of the ink button 44 in FIGS. 2-4 is performed when the ink menu process is executed by the controller 11.

When the ink menu process is started, the controller 11 at S110 displays the ink menu screen 50 (see FIG. 2) on the display device 13. The controller 11 at S120 obtains the internal cartridge information via the cartridge interface 17 from the information memory of each of the cartridge circuits 4*a*, 4*b*, 4*c*, 4*d*.

The controller 11 at S130 determines whether the model-number button 52 is selected on the ink menu screen 50. When the model-number button 52 is not selected, the controller 11 at S140 determines whether the remaining-amount button 51 is selected. When the remaining-amount button 51 is not selected, this flow goes to S150. The controller 11 at S150 determines whether any of the buttons other than the remaining-amount button 51 and the model-number button 52 is selected. When none of the buttons is selected, this flow goes to S130. When another button is selected, the controller 11 at S160 executes a processing corresponding to the selected button, and this flow goes to S110.

When the model-number button 52 is selected at S130, this flow goes to S170. The controller 11 at S170 determines whether the vendor server 200 is accessible. When the vendor server 200 is not accessible, this flow goes to S210. The controller 11 at S210 creates the conforming-model-number information 56 (see FIG. 2) to be displayed on the conformance-information screen 55, based on the internal cartridge information. After the processing at S210, this flow goes to S220.

When the controller 11 at S170 determines that the vendor server is accessible, this flow goes to S180. The controller 11 at S180 obtains the server cartridge information corresponding to each of the cartridges 3*a*, 3*b*, 3*c*, 3*d* in the image processing apparatus 10, from the vendor server 200 via the first communication interface 19.

The controller 11 at S190 determines whether the server cartridge information obtained at S180 is different from the internal cartridge information obtained at S120. In the present embodiment, more specifically, the controller 11 determines whether the non-internal conforming model number is included in the conforming model numbers represented by the conformance information contained in the server cartridge information.

When the conforming model numbers in the server cartridge information do not include the non-internal conforming model number, this flow goes to S210. When the conforming model numbers in the server cartridge information include the non-internal conforming model number, this flow goes to S200.

The controller 11 at S200 creates the conforming-model-number information 56 (see FIG. 2) to be displayed on the conformance-information screen 55, based on the internal cartridge information and the server cartridge information. The processing at S200 is different from the processing at S210 in that, in the case where the conforming model numbers in the server cartridge information includes the non-internal conforming model number, the controller 11 creates the non-internal conforming model number such that the non-internal conforming model number is included in the conforming-model-number information 56 and such that the non-internal conforming model number is to be displayed in a display manner different from that of the other conforming model numbers as described above. In the case where the non-internal conforming model number is not included in the conforming model numbers in the server cartridge information, the processing at S200 is substantially the same as the processing at S210.

The controller 11 at S220 obtains the ISO-based printable number for each color for each of the conforming cartridges represented by the conforming-model-number information created at S200 or S210. The ISO-based printable number has already been obtained at S120 or S180 and temporarily stored in the storage 12. Thus, the controller 11 may at S220 obtain the ISO-based printable number from the storage 12, for example.

The controller 11 at S230 uses the above-described calculating method, for example, to calculate the consumption-amount-based printable number for each color for each of the conforming cartridges represented by the conforming-model-number information created at S200 or S210. That is, the controller 11 calculates the unit amount of ink usage to calculate the consumption-amount-based printable number using the unit amount of ink usage for each of the four colors. After the processing at S230, this flow goes to S240 (see FIG. 6).

The controller 11 at S240 displays the conformance-information screen 55 (see FIG. 2) on the display device 13. The controller 11 at S250 determines whether a state in which the image processing apparatus 10 is capable of performing short-range wireless communication with another wireless communication device via the short-range wireless communication interface 21 is established. That is, the controller 11 determines whether another wireless communication device capable of performing wireless communication in the short-range wireless communication method is disposed in the communicable area of the short-range wireless communication interface 21.

When the state in which the image processing apparatus 10 is capable of performing the short-range wireless communication is established, the controller 11 at S260 transmits data on the conforming-model-number information 56 to the other wireless communication device via the short-range wireless communication interface 21, and this flow goes to S240. When the data on the conforming-model-number information 56 is transmitted to the other wireless communication device at S260, the other wireless communication device displays the conforming-model-number information 56.

When the controller 11 at S250 determines that no wireless communication device is disposed in the communicable area of the short-range wireless communication interface 21, this flow goes to S270. The controller 11 at S270 determines whether any button on the conformance-information screen 55 is selected. When no button is selected, this flow goes to S250. When any button is selected, this flow goes to S280.

The controller 11 at S280 determines which of the print button 57 and the printable-number button 58 is selected. When the selected button is the print button 57, the controller 11 at S290 controls the printing device 16 to print the conforming-model-number information 56, and this flow goes to S240. When the selected button is the printable-number button 58, this flow goes to S300.

The controller 11 at S300 displays the detailed-information screen 60 (see FIG. 2) on the display device 13. It is noted that the controller 11 may execute the processings at S250 and S260 also in the state in which the detailed-information screen 60 is displayed, to transmit data on the conformance detailed information 61 to another wireless communication device in the short-range wireless communication method to cause the other wireless communication device to display the conformance detailed information 61.

The controller 11 at S310 determines whether the information button 64 is selected on the detailed-information screen 60. When the information button 64 is not selected, this flow goes to S300. When the information button 64 is selected, the controller 11 at S320 displays the displayed-number explaining screen 85 (see FIG. 3) on the display device 13. The controller 11 at S330 determines whether the OK button 87 is selected on the displayed-number explaining screen 85. When the OK button 87 is not selected, this flow goes to S320. When the OK button 87 is selected, this flow goes to S300.

Figure 5:
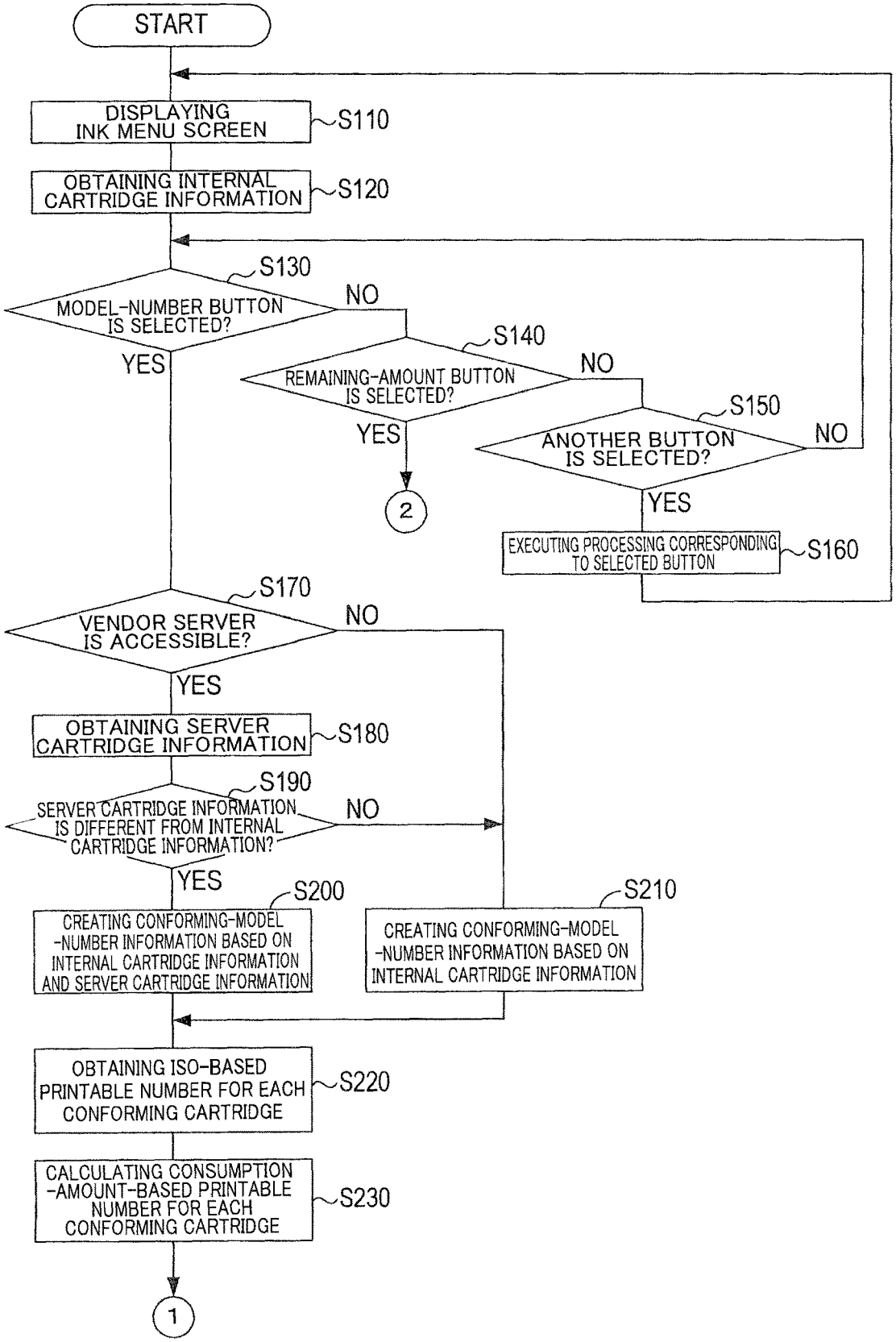
FIG. 5 is a flowchart representing a portion of an ink menu process.
Figure 6:
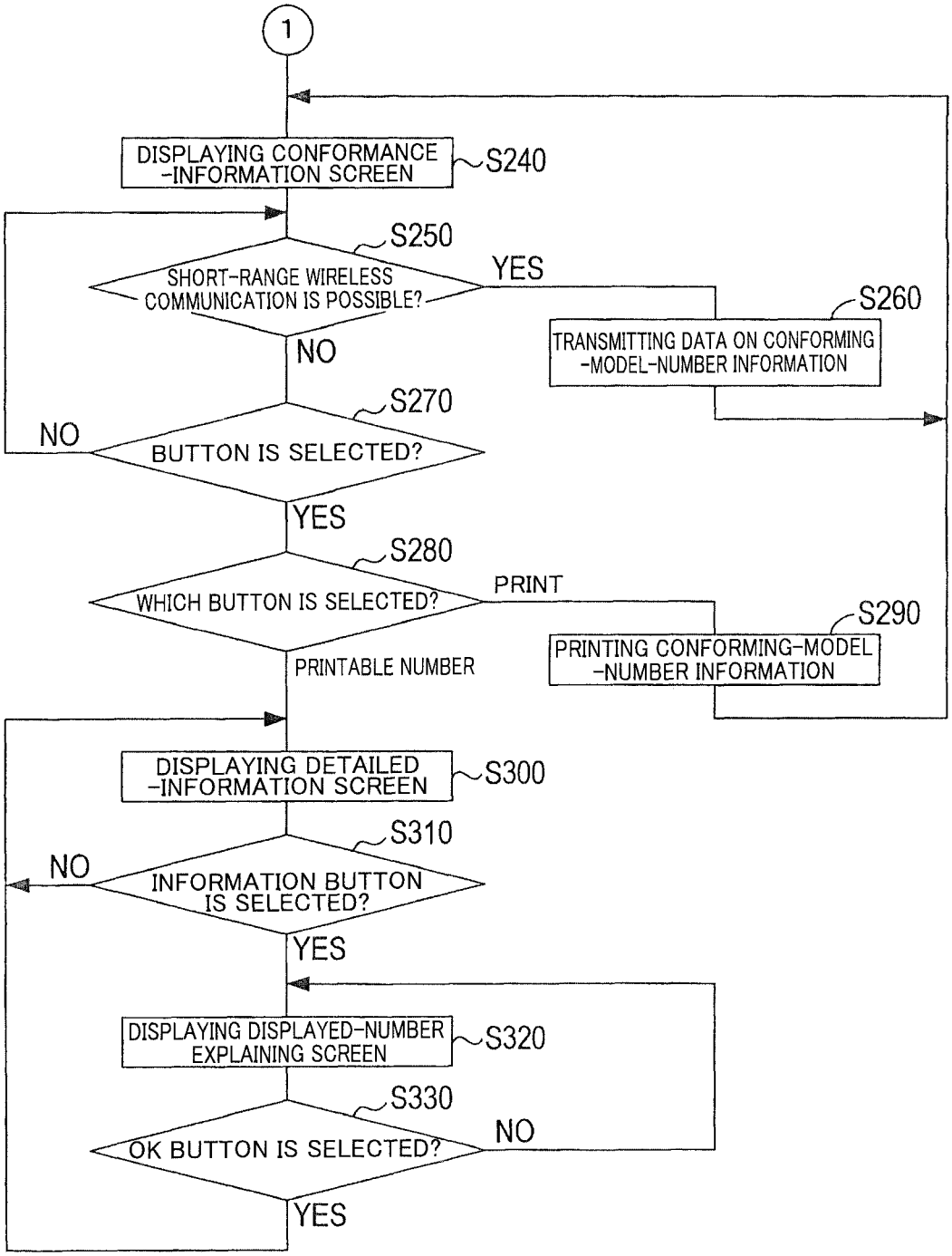
FIG. 6 is a flowchart representing another portion of the ink menu process (continued from S230 in FIG. 5)
Figure 7:
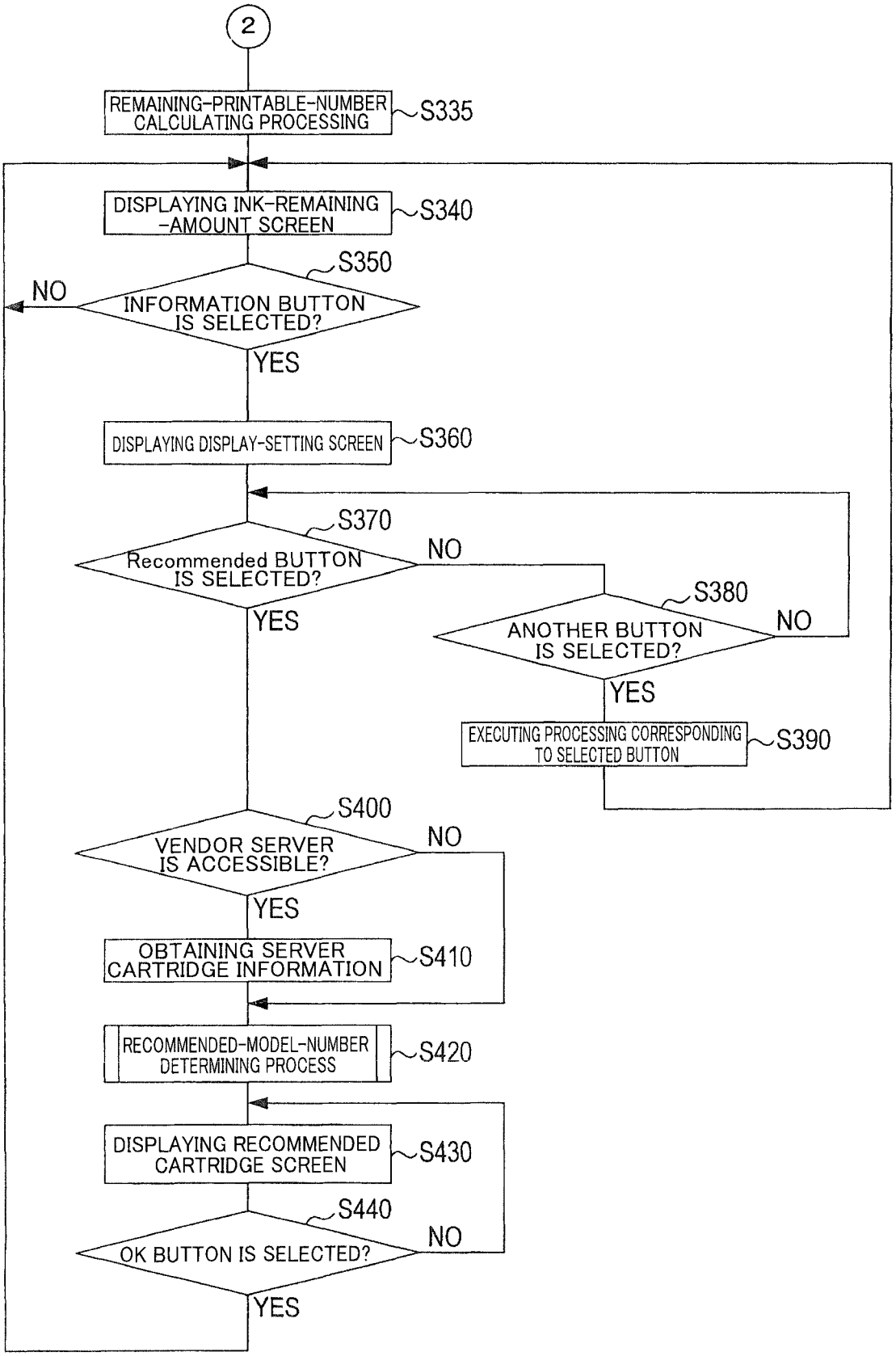
FIG. 7 is a flowchart representing yet another portion of the ink menu process (continued from S140 in FIG. 5)

When the controller 11 at S140 in FIG. 5 determines that the remaining-amount button 51 is selected, this flow goes to S335 (see FIG. 7). The controller 11 executes a remaining-printable-number calculating processing at S335. Specifically, the controller 11 calculates the remaining printable numbers for the respective cartridges 3*a*, 3*b*, 3*c*, 3*d* mounted at present. Specifically, the controller 11 calculates the ISO-based remaining printable numbers and the consumption-amount-based remaining printable numbers as described above.

The controller 11 at S340 displays the ink-remaining-amount screen 70 (see FIG. 4) on the display device 13. The displayed ink-remaining-amount screen 70 contains the printable-number object 72 representing the remaining printable number set to be displayed among the remaining printable numbers calculated at 335.

The controller 11 at S350 determines whether the information button 73 is selected on the ink-remaining-amount screen 70. When the information button 73 is not selected, this flow goes to S340. When the information button 73 is selected, this flow goes to S360.

The controller 11 at S360 displays the display-setting screen 75 on the display device 13. The controller 11 at S370 determines whether the Recommended button 78 is selected on the display-setting screen 75. When the Recommended button 78 is not selected, the controller 11 at S380 determines whether another button, i.e., the ISO-basis button 76 or the consumption-amount-basis button 77, is selected. When none of the buttons is selected, this flow goes to S370.

When the ISO-basis button 76 or the consumption-amount-basis button 77 is selected, the controller 11 at S390 executes a processing corresponding to the selected button, and this flow goes to S340. At S390, the controller 11 executes display setting corresponding to the selected button as described above.

When the controller 11 at S370 determines that the Recommended button 78 is selected, this flow goes to S400. As in the processing at S170, the controller 11 at S400 determines whether the vendor server 200 is accessible. When the vendor server 200 is not accessible, this flow goes to S420. When the vendor server 200 is accessible, this flow goes to S410. As in the processing at S180, the controller 11 at S410 obtains the server cartridge information corresponding to each of the cartridges 3*a*, 3*b*, 3*c*, 3*d* in the image processing apparatus 10, from the vendor server 200 via the first communication interface 19.

The controller 11 at S420 executes the recommended-model-number determining process. FIG. 8 illustrates the details of the recommended-model-number determining process. In the following description, "Rem_M" represents a remaining amount of the ink in the magenta-ink cartridge 3*a* mounted at present, "Rem_C" represents a remaining amount of the ink in the cyan-ink cartridge 3*b* mounted at present, "Rem_Y" represents a remaining amount of the ink in the yellow-ink cartridge 3*c* mounted at present, and "Rem_BK" represents a remaining amount of the ink in the black-ink cartridge 3*d* mounted at present.

Figure 8:
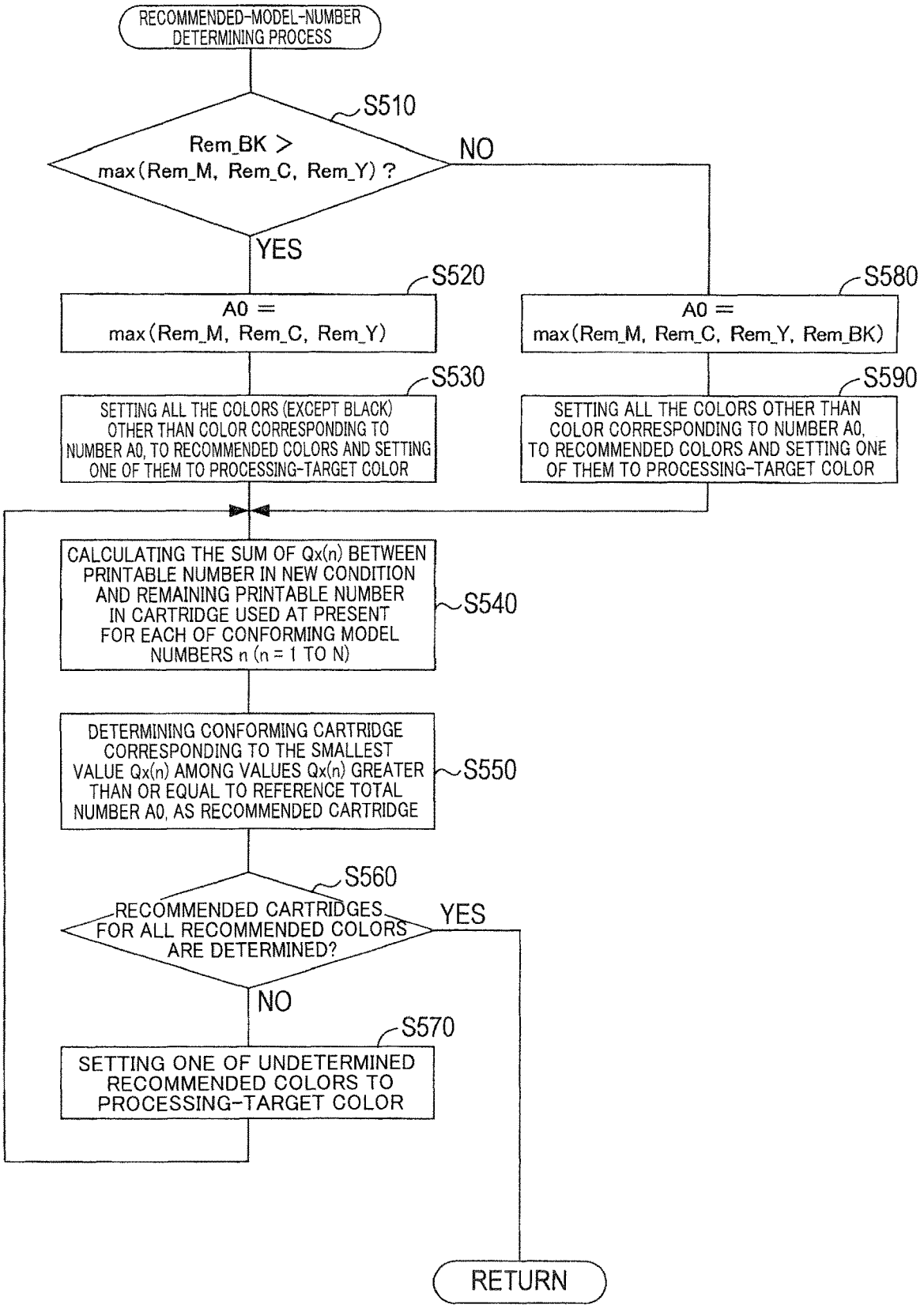
FIG. 8 is a flowchart representing the detail of a recommended-model-number determining process at S420.

When the recommended-model-number determining process illustrated in FIG. 8 is started, the controller 11 at S510 determines whether a color-remaining-amount largest value that is the largest value among the remaining ink amounts Rem_M, Rem_C, and Rem_Y is larger than the remaining ink amount Rem_BK. When the remaining ink amount Rem_BK is larger than the color-remaining-amount largest value, this flow goes to S520.

The controller 11 at S520 sets the color-remaining-amount largest value to a reference total number A0. The controller 11 at S530 sets all the colors (not including black) other than the color corresponding to the reference total number A0, to the recommended colors. The controller 11 sets one of the recommended colors to a processing-target color, and this flow goes to S540.

The controller 11 at S540 calculates the consumption-amount-based printable number in the new condition for each of the conforming model numbers n (n=1 to N) for the processing-target color. The controller 11 then calculates the sum Qx(n) of the calculated consumption-amount-based printable number and the consumption-amount-based remaining printable number in the cartridge used at present, for each of the conforming model numbers n for the processing-target color.

It is noted that the conforming model numbers n include the model number indicated by the conformance information contained in the internal cartridge information obtained at S120, and in the case where the server cartridge information is obtained at S410, the conforming model numbers n further include the model number indicated by the conformance information contained in the server cartridge information. In the case of the example in FIG. 2, the conforming model numbers n are one to three (n=1 to 3). For example, the conforming model number 1 corresponds to "LC3037", the conforming model number 2 corresponds to "LC3039", and the conforming model number 3 corresponds to "LC3041".

The controller 11 at S550 determines the conforming cartridge corresponding to the smallest value Qx(n) among the values Qx(n) greater than or equal to the reference total number A0, as the recommended cartridge for the processing-target color. The smallest value Qx(n) is the closest to the reference total number A0 among the values Qx(n) greater than or equal to the reference total number A0. It is noted that the recommended cartridge determined at S550 is a cartridge satisfying the first recommended condition.

The controller 11 at S560 determines whether the recommended cartridges respectively for all the recommended colors are determined. When there are recommended colors for which the recommended cartridge has not been determined, the controller 11 at S570 sets one of the undetermined recommended colors to the processing-target color, and this flow goes to S540. When the recommended cartridges respectively for all the recommended colors are determined at S560, this flow goes to S430 (see FIG. 7).

When the controller 11 at S510 determines that the remaining ink amount Rem_BK is less than or equal to the color-remaining-amount largest value, this flow goes to S580. The controller 11 at S580 sets the largest value among the remaining ink amounts Rem_M, Rem_C, Rem_Y, and Rem_BK for the respective four colors to the reference total number A0. The controller 11 at S590 sets all the colors other than the color corresponding to the reference total number A0, to the recommended colors. The controller 11 then sets one of the recommended colors to the processing-target color, and this flow goes to S540.

While the color-remaining-amount largest value is set to the reference total number A0 at S520 in the present embodiment, the controller 11 may set a value different from the largest value among the remaining ink amounts Rem_M, Rem_C, and Rem_Y for the three colors different from black (noted that the value is greater than the smallest value), to the reference total number A0. In this case, the controller 11 may at S530 set colors in each of which the remaining amount of the ink is less than the reference total number A0 among the colors (except black) other than the color corresponding to the reference total number A0, to the recommended colors.

The controller 11 may at S580 set a value different from the largest value among all the remaining ink amounts Rem_M, Rem_C, Rem_Y, and Rem_BK for the four colors (noted that the value is greater than the smallest value), to the reference total number A0. In this case, the controller 11 may at S590 set colors in each of which the remaining amount of the ink is less than the reference total number A0, among colors other than the color corresponding to the reference total number A0 among all the four colors, to the recommended colors.

At S430 in FIG. 7, the controller 11 displays the recommended cartridge screen 80 on the display device 13. The controller 11 at S440 determines whether the OK button 82 is selected. When the OK button 82 is selected, this flow returns to S340. When the OK button 82 is not selected, this flow returns to S430.

6. Effects

The embodiment described above achieves the following effects. That is, in the image processing apparatus 10 according to the present embodiment, the user can recognize the conforming model number for each color from the conformance-information screen 55, but in the case where there are a plurality of the conforming model numbers, the user cannot recognize differences among the conforming model numbers. That is, the user cannot recognize the model number with the largest printable number among the three model numbers "LC3037", "LC3039", and "LC3041", for example.

In the present embodiment, however, the user can operate the image processing apparatus 10 to display the detailed-information screen 60, allowing the user to recognize the printable number for each color for each of the conforming model numbers. Thus, even in the case where there are a plurality of the conforming model numbers for the same color, the user can appropriately determine which cartridge is to be purchased among the model numbers, based on the printable number for each of the conforming model numbers. Accordingly, the image processing apparatus 10 according to the present embodiment can appropriately provide the user with useful information for purchasing the cartridge.

In the present embodiment, in addition to obtaining the internal cartridge information from the cartridge circuit of the cartridge being mounted, the image processing apparatus 10 obtains the server cartridge information from the vendor server 200 in a state in which the image processing apparatus 10 can communicate with the vendor server 200.

Each of the conformance-information screen 55 and the detailed-information screen 60 also contains the conforming model numbers based on the server cartridge information. This configuration allows the user to recognize that a cartridge corresponding to the latest conforming model number not included in the internal cartridge information is on sale.

In addition, the conforming model number not included in the internal cartridge information is displayed on the conformance-information screen 55 in the display manner different from that of the conforming model number included in the internal cartridge information. This configuration allows the user to more accurately determine the cartridge to be purchased. It is noted that, as on the conformance-information screen 55, the conforming model number not included in the internal cartridge information may be displayed on the detailed-information screen 60 in the display manner different from that of the conforming model number included in the internal cartridge information.

The detailed-information screen 60 is displayed when the printable-number button 58 is selected on the conformance-information screen 55. That is, after the conformance-information screen 55 is displayed, the user can cause the image processing apparatus 10 to display the detailed-information screen 60 as needed, and may not display the detailed-information screen 60 in the case where necessary information is sufficiently obtained only on the conformance-information screen 55.

In the present embodiment, the image processing apparatus 10 is capable of displaying the recommended cartridge screen 80 illustrated in FIG. 4. Displaying the recommended cartridge screen 80 allows the user to recognize the colors and the model numbers of the cartridges to be purchased, in order that the cartridges of a plurality of colors become empty substantially at the same time. Such information is especially useful for the user who wants to replace the cartridges of a plurality of colors at one time.

In the present embodiment, the vendor server 200 is one example of an information processing device. The first communication interface 19 is one example of a communication interface. Each of the cartridges 3*a*-3*d* is one example of a container. The ink stored in the cartridges 3*a*-3*d* is one example of a colorant. The printing device 16 is one example of an image forming device. The consumption-amount-based printable number is one example of a first initial formable number. Each of the cartridge circuits 4*a*, 4*b*, 4*c*, 4*d* is one example of a conformance-information storage. The cartridge interface 17 is one example of a container interface. The printable-number button 58 is one example of a detailed-information object.

The remaining printable number at S540 is one example of a first total number. The printable number at S540 is one example of a second total number.

7. Modifications

While the embodiment has been described above, it is to be understood that the disclosure is not limited to the details of the illustrated embodiment, but may be embodied with various changes and modifications, which may occur to those skilled in the art, without departing from the spirit and scope of the disclosure.

7.1. First Modification

The recommended-model-number determining process at S420 in FIG. 7 may be a process different from the process illustrated in FIG. 8. That is, the recommended condition for determining the recommended cartridge may be different from the first recommended condition in the above-described embodiment.

Figure 9:
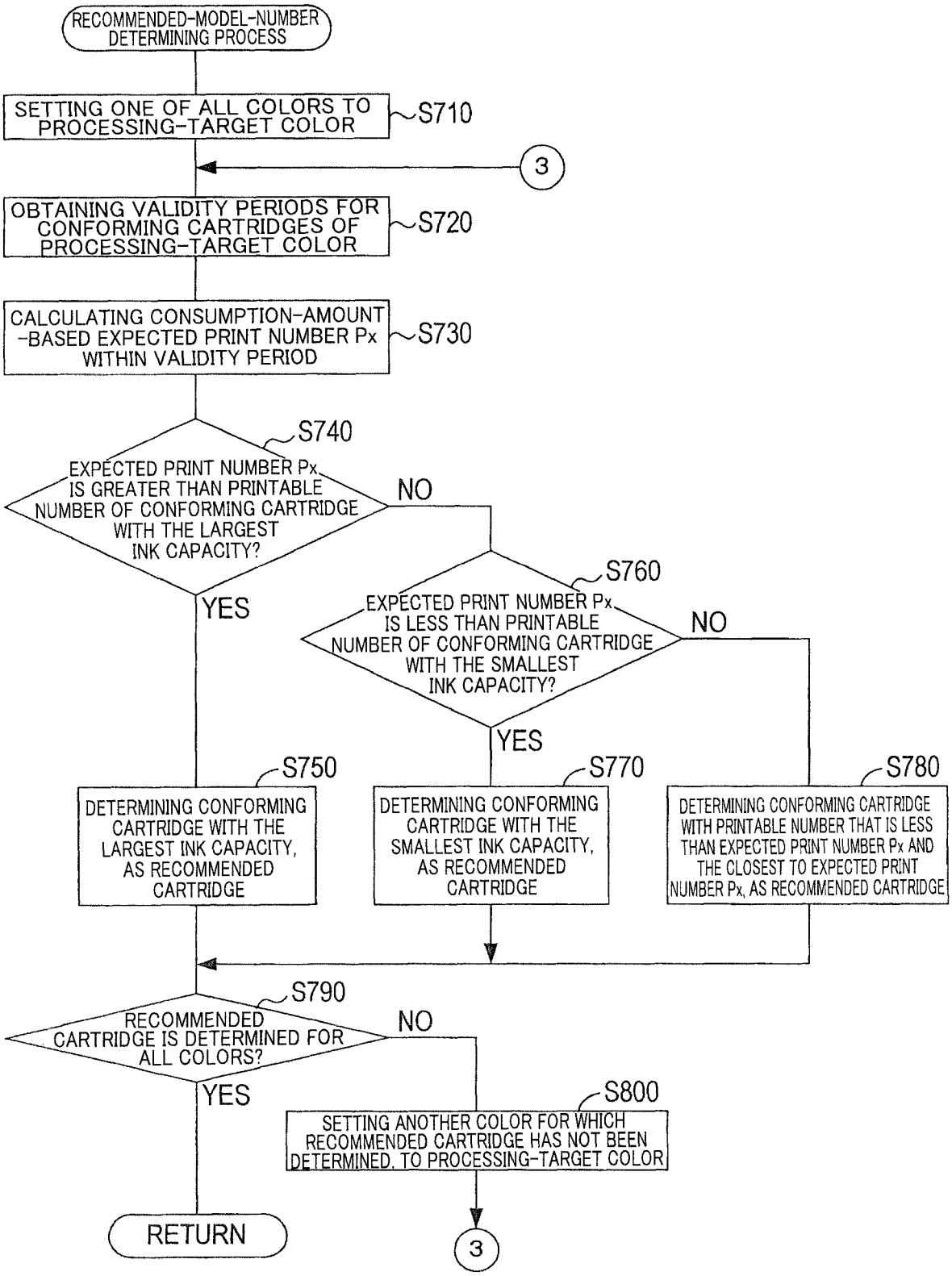
FIG. 9 is a flowchart representing another example of the recommended-model-number determining process.

For example, the controller 11 may execute a recommended-model-number determining process illustrated in FIG. 9. In the recommended-model-number determining process illustrated in FIG. 9, the controller 11 determines the conforming cartridge satisfying a second recommended condition, as the recommended cartridge for each of the recommended colors.

The second recommended condition is generally a condition in which, in the case where it is assumed that the user causes the image forming apparatus to perform printing at the same pace as in the past use, all the ink of the initial containing amount is consumed within the validity period, and the printable number in the new condition is the closest to the number of the recording sheets expected to be printed within the validity period. There will be specifically described the recommended-model-number determining process in FIG. 9.

When the recommended-model-number determining process in FIG. 9 is started, the controller 11 at S710 sets one of all the colors (the four colors in the present embodiment) to the processing-target color. The controller 11 at S720 obtains the validity periods for the respective conforming cartridges for the processing-target color.

The controller 11 at S730 calculates a consumption-amount-based expected print number Px within the validity period for each of the conforming cartridges for the processing-target color. The consumption-amount-based expected print number Px is the number of the recording sheets expected to be printed within the validity period in the case where it is assumed that the ink of each color will be used at the same pace as in the past use based on the past use of the user. The expected print number Px may be, for example, calculated by calculating an average number of the recording sheets printed per day based on the number of the recording sheets printed within a past particular period and multiplying the average number of the printed sheets by the number of days within the validity period.

The controller 11 at S740 determines whether the expected print number Px calculated at S730 is greater than the maximum printable number that is the printable number of the conforming cartridge with the largest ink capacity among the conforming cartridges for the processing-target color. It is noted that the printable number used at S740 and S760 which will be described below may be a value converted based on ISO and may be a value converted based on the consumption amount.

When the controller 11 at S740 determines that the expected print number Px is greater than the maximum printable number, this flow goes to S750. The controller 11 at S750 determines the conforming cartridge with the largest ink capacity among the conforming cartridges for the processing-target color, as the recommended cartridge for the processing-target color.

The controller 11 at S790 determines whether the recommended cartridge is determined for each of all the colors. When the recommended cartridge is determined for each of all the colors, the recommended-model-number determining process ends, and the flow goes to S430 (FIG. 7). When there is at least one color for which the recommended cartridge has not been determined, this flow goes to S800. The controller 11 at S800 sets one of the at least one color for which the recommended cartridge has not been determined, to the processing-target color, and this flow goes to S720.

When the controller 11 at S740 determines that the expected print number Px is less than or equal to the maximum printable number, this flow goes to S760. The controller 11 at S760 determines whether the expected print number Px calculated at S730 is less than the minimum printable number that is the printable number of the conforming cartridge with the smallest ink capacity among the conforming cartridges for the processing-target color.

When the controller 11 at S760 determines that the expected print number Px is less than the minimum printable number, this flow goes to S770. The controller 11 at S770 determines the conforming cartridge with the small ink capacity among the conforming cartridges for the processing-target color, as the recommended cartridge for the processing-target color. After the processing at S770, this flow goes to S790.

When the controller 11 at S760 determines that the expected print number Px is greater than or equal to the minimum printable number, this flow goes to S780. The controller 11 at S780 determines the conforming cartridge with the printable number that is less than the expected print number Px and the closest to the expected print number Px, as the recommended cartridge. After the processing at S780, this flow goes to S790.

It is noted that the expected print number Px in FIG. 9 is one example of an in-validity-period expected number. The processing at S730 is one example of an expected-number calculation processing. In the case where the process in FIG. 9 is executed as the recommended-model-number determining process at S420, the printable number calculated at S220 or S230 is one example of a second initial formable number.

7.2. Second Modification

The recommended cartridges may be displayed on a screen different from the recommended cartridge screen 80. For example, the model numbers of the respective recommended cartridges may be displayed on the conformance-information screen 55 or the detailed-information screen 60 in FIG. 2. Alternatively, the model numbers of the respective recommended cartridges may be displayed in a display manner different from that of the other model numbers.

7.3. Third Modification

In the case where the model-number button 52 is selected on the ink menu screen 50 (see FIG. 2), the display device 13 may display not the conformance-information screen 55 but the detailed-information screen 60. In this case, a button corresponding to the print button 57 may be displayed on the detailed-information screen 60.

7.4. Fourth Modification

While the number of colors of the ink stored in the cartridges for printing is four (magenta, cyan, yellow, and black) in the above-described embodiment, this configuration is one example. The number of the cartridges may be any number other than four, and the ink color for each cartridge may be any color.

7.5. Fifth Modification

The present disclosure may be applied to image forming apparatuses different in configuration from the image forming apparatus configured to supply the ink from the cartridge. For example, the present disclosure may be applied to image forming apparatuses including a storage for storing the ink of colors and configured to perform printing using the ink stored in the storage.

In the image forming apparatuses of this type, the storage is not removable and mountable and fixed in the image forming apparatus in most cases. This image forming apparatus is configured to allow the user to replenish the storage with the ink. That is, the user can purchase a container containing ink for replenishment, such as an ink bottle and an ink package, and supply the ink from the container to the storage to replenish the storage with the ink.

Also in the image forming apparatuses of this type, the user considers purchasing the container so as to replenish the storage with the ink before or after the storage becomes empty of the ink. At the time of this consideration, in the case where there are containers of a plurality of types for the same color, the user needs to select one of the containers.

Thus, by applying the present disclosure to the image forming apparatuses of this type, it is possible to achieve the same effects as achieved in the above-described embodiment. That is, the user can obtain useful information for purchasing the container, making it possible to easily and appropriately determine the container to be purchased.

7.6. Sixth Modification

The present disclosure may be applied to image forming apparatuses including a printing mechanism different from the ink-jet printing mechanism. For example, the present disclosure may be applied to image forming apparatuses including an electrophotographic printing mechanism, i.e., a printing mechanism configured to form an image on the recording sheet by transferring toner stored in a toner cartridge, to the recording sheet based on print data.

7.7. Other Modifications

The plurality of functions of one element in the above-described embodiment may be achieved by a plurality of elements, and one function of one element may be achieved by a plurality of elements. A plurality of functions of a plurality of elements may be achieved by one element, and one function achieved by a plurality of elements may be achieved by one element. The configurations in the above-described embodiment may be omitted partly. At least a portion of the configurations in the above-described embodiment may be added to or replaced with another portion of the configurations in the above-described embodiment.

What is claimed is:

1. An image forming apparatus, comprising:

an image forming device configured to form an image on a recording medium by applying a colorant onto the recording medium from at least one container corresponding respectively to at least one color;

a display device; and a controller configured to:

obtain conformance information, for each of the at least one color, representing each of the at least one container conforming to the image forming apparatus;

obtain usage information related to a relationship between (i) the total number of recording media on which images are respectively formed by the image forming device within a past particular period and (ii) a total amount of the colorant of the at least one color which is used by the image forming device within the past particular period;

calculate a first initial formable number for each of the at least one color based on the obtained usage information, the first initial formable number representing the total number of recording media on which images are respectively formable using the colorant with a particular initial containing amount which is stored in each of the at least one container; and control the display device to display a detailed-information screen containing conformance detailed information for each of the at least one color, the conformance detailed information being information in which the obtained conformance information and the first initial formable number are associated with each other.

2. The image forming apparatus according to claim 1, wherein each of the at least one container is mountable on and removable from the image forming apparatus, wherein the image forming apparatus further comprises a mount portion on which the at least one container is mountable, wherein the image forming device is configured to form the image on the recording medium by applying the colorant to the recording medium from the at least one container being mounted on the mount portion, wherein the conformance information represents each of the at least one container mountable on the mount portion, and wherein the particular initial containing amount is an amount of the colorant contained in each of the at least one container in a new condition.

3. The image forming apparatus according to claim 2, wherein each of the at least one container comprises a conformance-information storage storing the conformance information, wherein the image forming apparatus further comprises a container interface electrically connectable to the conformance-information storage of each of the at least one container mounted on the mount portion, and wherein the controller is configured to obtain the conformance information stored in the conformance-information storage, from the conformance-information storage via the container interface.

4. The image forming apparatus according to claim 3, further comprising:

a communication interface configured to perform data communication with an information processing device having the conformance information and different from the image forming apparatus; and an input interface, wherein the controller is configured to obtain the conformance information from the information processing device via the communication interface, wherein the controller is configured to control the display device to display a conformance-information screen containing the obtained conformance information and a particular-detailed-information requesting object, wherein the controller is configured to control the display device to display the detailed-information screen when the particular-detailed-information requesting object on the conformance-information screen is selected with the input interface, and wherein the controller is configured to, when the conformance information is obtained not via the container interface but via the communication interface, display the conformance information in a display manner different from a display manner in which the conformance information obtained via the container interface is displayed.

5. The image forming apparatus according to claim 1, further comprising an input interface, wherein the controller is configured to control the display device to display a conformance-information screen containing the obtained conformance information and a particular-detailed-information requesting object, and wherein the controller is configured to control the display device to display the detailed-information screen when the particular-detailed-information requesting object on the conformance-information screen is selected with the input interface.

6. The image forming apparatus according to claim 1, further comprising a communication interface configured to perform data communication with an information processing device having the conformance information and different from the image forming apparatus, wherein the controller is configured to obtain the conformance information from the information processing device via the communication interface.

7. The image forming apparatus according to claim 1, wherein the controller is configured to:

when a plurality of pieces of conformance information obtained as the conformance information correspond respectively to a plurality of containers as the at least one container for each of particular at least one recommended color of the at least one color, extract one container satisfying a particular recommended condition from among the plurality of containers; and control the display device to display recommendation information representing the extracted one container.

8. The image forming apparatus according to claim 7, wherein the controller is configured to:

obtain validity-period information representing a validity period of the container conforming to the image forming apparatus;

based on the usage information and the validity-period information, calculate an in-validity-period expected number that is the number of recording media on which images are expected to be respectively formed by the image forming device within the validity period for each of the plurality of containers; and obtain a second initial formable number that is the total number of recording media on which images are respectively formable using the colorant with the particular initial containing amount for each of the plurality of containers, and wherein the particular recommended condition comprises a condition that the second initial formable number is less than the in-validity-period expected number and the closest to the in-validity-period expected number among the plurality of containers.

9. The image forming apparatus according to claim 7, wherein the image forming device is configured to form an image using colorants corresponding respectively to a plurality of colors, wherein the controller is configured to:

determine a reference color from among the plurality of colors other than a color for which a remaining amount of the colorant is the smallest;

determine a color for which the remaining amount of the colorant is less than that for the reference color among the plurality of colors, to a recommended color as the particular at least one recommended color;

calculate a reference total number that is the total number of recording media on which images are respectively formable using the colorant of the reference color remaining at present;

calculate a first total number that is the total number of recording media on which images are respectively formable using the colorant of the recommended color remaining at present; and obtain a second total number that is the total number of recording media on which images are respectively formable using the colorant contained in each of the plurality of containers in a new condition, and wherein the particular recommended condition comprises a condition that a sum of the second total number and the first total number is greater than the reference total number and the closest to the reference total number among the plurality of containers.

* * * * *